US008678985B2

(12) United States Patent
Mattox

(10) Patent No.: US 8,678,985 B2
(45) Date of Patent: Mar. 25, 2014

(54) BALANCE TRAINING AND EXERCISE DEVICE

(76) Inventor: E. Michael Mattox, Petoskey, MI (US)

( * ) Notice: Subject to any disclaimer, the term of this patent is extended or adjusted under 35 U.S.C. 154(b) by 895 days.

(21) Appl. No.: 11/836,544

(22) Filed: Aug. 9, 2007

(65) Prior Publication Data

US 2008/0039304 A1 Feb. 14, 2008

Related U.S. Application Data

(60) Provisional application No. 60/821,992, filed on Aug. 10, 2006.

(51) Int. Cl.
*A63B 26/00* (2006.01)
*A63B 22/14* (2006.01)

(52) U.S. Cl.
USPC ..... 482/142; 482/148; 482/146

(58) Field of Classification Search
USPC ..... 482/130, 142, 96, 115, 136, 147
See application file for complete search history.

(56) References Cited

U.S. PATENT DOCUMENTS

| | | | | | |
|---|---|---|---|---|---|
| 1,357,940 | A | * | 11/1920 | Berry | 220/642 |
| 2,471,528 | A | * | 5/1949 | Kling | 472/135 |
| 2,615,495 | A | * | 10/1952 | Hilliker | 472/25 |
| 2,804,123 | A | * | 8/1957 | Kling | 472/25 |
| 2,826,423 | A | * | 3/1958 | Erickson | 280/18.1 |
| 2,826,424 | A | * | 3/1958 | Erickson | 280/18.1 |
| 2,829,892 | A | * | 4/1958 | Ludwig | 482/146 |
| 2,878,858 | A | * | 3/1959 | Winchester | 472/25 |
| 2,930,430 | A | * | 3/1960 | Bloom | 297/271.6 |
| 2,971,767 | A | * | 2/1961 | Eaton | 280/18.1 |
| 3,041,070 | A | * | 6/1962 | Kerstein | 472/25 |
| 3,123,374 | A | * | 3/1964 | MacLeod | 280/18.1 |
| 3,188,087 | A | * | 6/1965 | Larson, Jr. | 273/115 |
| 3,201,120 | A | * | 8/1965 | Moravetz | 482/26 |
| 3,262,701 | A | * | 7/1966 | Howland | 482/146 |
| 3,306,626 | A | * | 2/1967 | Kawada | 280/205 |
| 3,380,735 | A | * | 4/1968 | Rigby | 482/18 |
| 3,451,672 | A | * | 6/1969 | Kazdan | 472/4 |
| 3,586,321 | A | * | 6/1971 | Gehrke et al. | 482/146 |
| 3,604,726 | A | * | 9/1971 | Tracy | 280/205 |
| 3,612,519 | A | * | 10/1971 | Larson | 482/147 |
| 3,628,206 | A | * | 12/1971 | Mecham | 280/18.1 |
| 3,716,229 | A | * | 2/1973 | Van Der Cleyen et al. | 482/77 |
| 3,751,111 | A | * | 8/1973 | Taylor et al. | 297/452.27 |
| 3,862,768 | A | * | 1/1975 | England | 280/205 |
| 3,895,794 | A | * | 7/1975 | England | 482/146 |
| 3,911,907 | A | * | 10/1975 | Smith, Jr. | 482/1 |
| 3,964,790 | A | * | 6/1976 | Bergeron | 297/451.5 |
| 3,999,801 | A | * | 12/1976 | Walters | 297/451.4 |
| D247,323 | S | * | 2/1978 | Risberg | D21/412 |

(Continued)

OTHER PUBLICATIONS

Rocking coffee table seat http://www.sfgate.com/homeandgarden/article/Melanie-Schnack-In-search-of-a-rocking-revival-2785713.php#photo-2203421.*

*Primary Examiner* — Robert Long
(74) *Attorney, Agent, or Firm* — McGarry Bair PC

(57) ABSTRACT

A balance training and exercise device comprises a rigid, shallow disc adapted to accommodate a user's feet or knees. A user moves in such a manner as to move the disc forwards or backwards, or to rotate the disc. A thickened firm, resilient pad can be placed within the disc, and the user can perform the same movements while standing atop the pad. Arm strengthening means can also be used in combination with the disc.

16 Claims, 11 Drawing Sheets

(56) References Cited

U.S. PATENT DOCUMENTS

| | | | | | |
|---|---|---|---|---|---|
| 4,141,588 | A | * | 2/1979 | Anderson | 297/271.5 |
| 4,191,371 | A | * | 3/1980 | Armer, Jr. | 482/146 |
| 4,307,880 | A | * | 12/1981 | Abram | 482/142 |
| 4,448,411 | A | * | 5/1984 | Parker | 482/34 |
| 4,512,578 | A | * | 4/1985 | Dalton | 273/110 |
| 4,613,131 | A | * | 9/1986 | Anderson | 482/146 |
| D286,802 | S | * | 11/1986 | Ahlberg | D21/688 |
| 4,759,542 | A | * | 7/1988 | Hudec | 482/34 |
| 4,801,140 | A | * | 1/1989 | Bergeron | 482/146 |
| D299,942 | S | * | 2/1989 | Klawitter | D21/443 |
| 4,997,091 | A | * | 3/1991 | McCrea | 206/584 |
| 5,048,823 | A | * | 9/1991 | Bean | 482/146 |
| 5,186,990 | A | * | 2/1993 | Starcevich | 428/35.6 |
| D342,027 | S | * | 12/1993 | Paulsen | D9/456 |
| 5,306,220 | A | * | 4/1994 | Kearney | 482/94 |
| 5,330,399 | A | * | 7/1994 | Fan | 482/34 |
| 5,351,830 | A | * | 10/1994 | Bender et al. | 206/524.8 |
| 5,492,320 | A | * | 2/1996 | Hoffman et al. | 473/594 |
| 5,542,135 | A | * | 8/1996 | Ozrovitz et al. | 5/424 |
| 5,549,536 | A | * | 8/1996 | Clark | 482/146 |
| D375,985 | S | * | 11/1996 | Dailey et al. | D21/688 |
| D377,812 | S | * | 2/1997 | Rister | D21/412 |
| 5,603,662 | A | * | 2/1997 | Kreaman-Stern | 472/25 |
| 5,643,154 | A | * | 7/1997 | Awbrey et al. | 482/111 |
| D385,318 | S | * | 10/1997 | Videtto | D21/688 |
| D398,671 | S | * | 9/1998 | Videtto | D21/662 |
| 5,807,210 | A | * | 9/1998 | Devlin | 482/52 |
| 5,810,703 | A | * | 9/1998 | Stack | 482/146 |
| 5,833,587 | A | * | 11/1998 | Strong et al. | 482/123 |
| D405,135 | S | * | 2/1999 | Scott | D21/688 |
| 5,887,944 | A | * | 3/1999 | Boost | 297/258.1 |
| 5,893,570 | A | * | 4/1999 | Kehrmann | 280/18.1 |
| 5,897,474 | A | * | 4/1999 | Romero | 482/146 |
| 5,951,403 | A | * | 9/1999 | Trzos | 472/25 |
| 6,019,712 | A | * | 2/2000 | Duncan | 482/110 |
| 6,098,319 | A | * | 8/2000 | Epstein | 36/159 |
| D444,183 | S | * | 6/2001 | Hochstrasser | D21/398 |
| 6,461,285 | B1 | * | 10/2002 | Theunissen et al. | 482/146 |
| 6,551,225 | B1 | * | 4/2003 | Romero | 482/146 |
| 6,575,885 | B1 | * | 6/2003 | Weck et al. | 482/147 |
| 6,616,583 | B1 | * | 9/2003 | Stack | 482/146 |
| D481,655 | S | * | 11/2003 | McKee | D12/11 |
| 6,709,340 | B2 | * | 3/2004 | Gordon | 472/134 |
| 6,730,005 | B1 | * | 5/2004 | Liao | 482/142 |
| 6,740,008 | B1 | * | 5/2004 | Ho et al. | 482/34 |
| 6,746,372 | B2 | * | 6/2004 | Hsu | 482/34 |
| 6,789,508 | B2 | * | 9/2004 | Hull | 119/702 |
| 6,837,838 | B2 | * | 1/2005 | List | 482/147 |
| 6,872,175 | B2 | * | 3/2005 | Lin | 482/146 |
| 6,916,276 | B1 | * | 7/2005 | Robinson | 482/51 |
| 6,921,353 | B2 | * | 7/2005 | Chuang | 482/52 |
| 6,942,604 | B2 | * | 9/2005 | Teff | 482/79 |
| 6,945,920 | B1 | * | 9/2005 | Kemery et al. | 482/146 |
| D510,201 | S | * | 10/2005 | Fubini et al. | D6/358 |
| D518,865 | S | * | 4/2006 | Goldman et al. | D21/803 |
| 7,044,558 | B2 | * | 5/2006 | Chiu | 297/452.41 |
| 7,112,168 | B2 | * | 9/2006 | Dalebout et al. | 482/146 |
| 7,156,788 | B1 | * | 1/2007 | Jackson et al. | 482/141 |
| D536,542 | S | * | 2/2007 | Chiu | D6/352 |
| D539,049 | S | * | 3/2007 | Zimmermann | D6/358 |
| D539,050 | S | * | 3/2007 | Zimmermann | D6/358 |
| 7,264,580 | B2 | * | 9/2007 | Lu | 482/146 |
| D553,866 | S | * | 10/2007 | Frias | D6/334 |
| 7,288,055 | B2 | * | 10/2007 | Blaum | 482/142 |
| D564,604 | S | * | 3/2008 | Mikail | D21/688 |
| 7,470,218 | B2 | * | 12/2008 | Williams | 482/51 |
| D585,098 | S | * | 1/2009 | Rauwerdink | D21/686 |
| 7,494,446 | B2 | * | 2/2009 | Weck et al. | 482/47 |
| 7,575,540 | B1 | * | 8/2009 | Dobrow et al. | 482/142 |
| 7,637,851 | B1 | * | 12/2009 | Lormil | 482/95 |
| 7,674,216 | B1 | * | 3/2010 | Bolling | 482/142 |
| 2003/0125174 | A1 | * | 7/2003 | Lin | 482/148 |
| 2003/0195098 | A1 | * | 10/2003 | Hsu | 482/148 |
| 2003/0232698 | A1 | * | 12/2003 | Couvillion et al. | 482/4 |
| 2004/0018924 | A1 | * | 1/2004 | Szydlowski et al. | 482/146 |
| 2004/0089774 | A1 | * | 5/2004 | Pace | 248/146 |
| 2004/0110608 | A1 | * | 6/2004 | Washington | 482/96 |
| 2006/0257519 | A1 | * | 11/2006 | Teufel | 425/447 |
| 2008/0060229 | A1 | * | 3/2008 | Epstein | 36/159 |
| 2009/0023566 | A1 | * | 1/2009 | Florczak | 482/142 |
| 2009/0215596 | A1 | * | 8/2009 | Obermaier | 482/142 |
| 2010/0009762 | A1 | * | 1/2010 | Takeda et al. | 463/47 |
| 2010/0022369 | A1 | * | 1/2010 | Schultheisz | 482/142 |

* cited by examiner

BALANCE TRAINING AND EXERCISE DEVICE

CROSS-REFERENCE TO RELATED APPLICATION

This application claims the benefit of U.S. provisional application Ser. No. 60/821,992, filed Aug. 10, 2006, which is incorporated herein by reference in its entirety.

BACKGROUND OF THE INVENTION

1. Field of the Invention

This invention relates generally to exercise devices. In one of its aspects, the invention relates to an exercise device designed to improve balance. In one of its aspects the invention relates to a method of performing an exercise that improves one's balance.

2. Description of the Related Art

Fitness-focused businesses such as gyms and workout tape production groups have experienced unprecedented growth in recent decades as more and more individuals have begun to focus on their health. Numerous exercise programs and routines have been developed to build muscle, such as Tae Bo and weight-lifting. Other programs, such as yoga, focus less on building muscle but more on building spirituality and flexibility.

A regimen somewhere between these two ends of the spectrum is Pilates. Pilates is a method of improving physical fitness that relies primarily on using the mind to control breathing and movement. The claimed benefit is that core postural muscles, or the muscles responsible for maintaining posture and balance of the body, are strengthened. Refining the core postural muscles can alleviate back pain and other such ailments. Additionally, by improving balance, an individual reduces his or her chances of injury due to falling or bumping into objects. Improved proprioception, or the sense of the locations of the parts of the body relative to the other parts of the body, is a result of increased balance and can likewise prevent accidents. Balance and proprioception are also of high importance to athletes, as they greatly affect performance.

Despite the popularity of Pilates, many individuals do not have time to take an exercise class or to complete an entire fitness routine at home. Instead, balance-building devices are being developed to enable simple and fast balance improvement.

One extremely popular device designed to improve balance is the Stability ball. A Stability ball is simply a large, spherical inflatable ball made of a burst-resistant material and designed to accommodate the weight of an adult with some deformation. A user can perform a variety of exercises on the ball, such as crunches, squats, and push-ups. The Resist-A-Ball® is the most common Stability ball, although many different versions have been produced to accommodate specific exercises, such as a weight-resistant version for combination balance and weight-training. Balance discs, which are inflatable, thickened circular members, can be used for similar applications.

Another device commonly used for improving balance is the Bosu® Balance Trainer. The Bosu® Balance Trainer comprises a semispherical inflatable portion of a construction similar to that of the Stability ball. The Trainer further comprises a circular, rigid, non-deforming platform attached onto the flat side of the semispherical portion. A user will typically stand on the Bosu® Balance Trainer with the platform on the ground. Although the Trainer remains stationary, a user can move while attempting to maintain a position on the Trainer in order to improve balance skills. The Bosu® Balance Trainer can also be used with the platform facing upwards to perform a variety of exercises. When it is used with the platform facing upwards, a user typically holds onto the platform with their hands to perform a push-up exercise. A user can instead stand on the platform, but the deforming nature of the semispherical portion in combination with the non-deforming platform make it difficult for the user to move while maintaining a position atop the platform. Additionally, only a slight tilting movement can be achieved when standing on the platform without the user falling or slipping off of the device.

SUMMARY OF THE INVENTION

According to the invention, a balance training and exercise device comprises a shallow, concave disc having an upper surface and a lower surface and the upper surface is adapted to support the feet or knees of a human user and an optional pad adapted to be placed on or mounted on the upper surface of the disc and at least partially fills the concave disc upper surface. The pad has an upper surface that is adapted to support the feet or knees of an adult user when the pad is placed within the disc. The disc and the pad are formed to impart sufficient rigidity to the disc so that the disc maintains its resiliency at least when the user stands on the pad when the pad is on the upper surface of the disc so that the user can perform a balance exercise by wobbling of the disc.

In one embodiment, the disc is formed to impart sufficient rigidity so that the disc functionally maintains its curvature on the bottom surface thereof beneath the feet of the user when a user stands directly on the upper surface of the disc. Desirably, the disc bottom surface is in the form of a partial spherical surface to permit wobbling of the disc in all directions. The disc and pad are formed to impart sufficient rigidity to the disc so that the disc maintains its curvature on the bottom surface thereof beneath the feet of the user, at least when the user stands on the pad when the pad is on the upper surface of the disc so that the user can perform a translational movement of the disc by wobbling of the disc. The disc can be formed of a variety of materials, including aluminum, steel, or plastic. The materials and the thickness of the disc are selected to accommodate the size and weight of a target group of users, such as children and adults.

The pad is formed of a material that is relatively resilient so that the weight of the user will cause the pad to deform to accommodate the feet of the user. The stiffness of the foam can vary over a wide range to accommodate the needs of a user. For example, stiffer, denser foams are typically used for conditioning athletes whereas more flexible, less dense foams are used for rehabilitation purposes. The pad can be formed of a variety of materials to achieve these functions, including plastic and elastomeric natural and synthetic materials and can include open cell as well as close cell foams. The density of the foams can range from about 2 to about 25 lbs./ft$^3$, with about 5-18 lbs./ft$^3$ being preferred. In one embodiment, the pad can be made of a firm, resilient self skinning polyurethane foam of about 18 lbs./ft$^3$ that is slightly compressible under the weight of a user but that otherwise maintains it integrity under the weight of a user. Foam materials include polyurethane, polyvinyl acetate among other materials. The pad can extend above a rim of the disc or can be below the rim or even with the rim.

In one embodiment, at least one elastic rope attached at one end to the disc and has a length adapted to extend from the disc to a hand of the user when the user is standing on the disc. Preferably, two elastic ropes can be attached to the disc, one for each hand of a user. Preferably, the elastic rope or ropes have a handle on another end adapted to be held by a user. In one embodiment, one end of the rope the or each rope extends through an aperture near a rim of the disc.

In another embodiment of the invention, a user support has a base that is adapted to be placed along a support surface adjacent the disc, at least one upright support member rigidly secured at a lower end to the base; and a hand grip mounted to an upper portion of the upright support member and adapted to be grasped by a user standing on the disc. The user can partially stabilize his or her balance by grasping the hand grip while performing exercises on the disc. In one embodiment, the upright support member comprises a pair of telescoping tubes that are selectively adjustable to adjust the height of the hand grip from the support surface. In another embodiment, the hand grips are adjustably mounted to the support surface for selective adjustment of the height of the hand grips with respect to the support surface.

Further according to the invention, a method for performing an exercise to improve balance of an individual comprises standing or kneeling on an upper surface of a shallow, concave disc as described in any of the embodiments set forth above with the lower surface thereon resting on a support surface, such as a floor, and rocking on the disc from side to side or forwardly and backwardly or any combination thereof, In one embodiment, the disc is moved during the rocking act along the support surface.

DESCRIPTION OF THE PREFERRED EMBODIMENT

Figure 1:
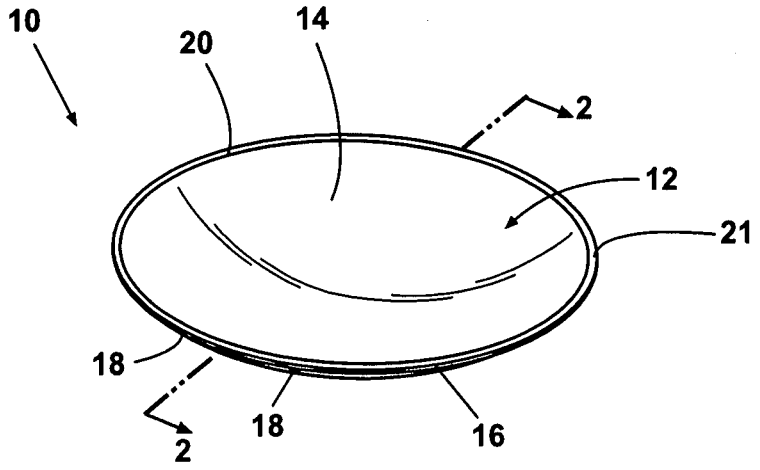
FIG. 1 is a perspective view of an exemplary embodiment of the balance training and exercise device of the invention.
Figure 2:
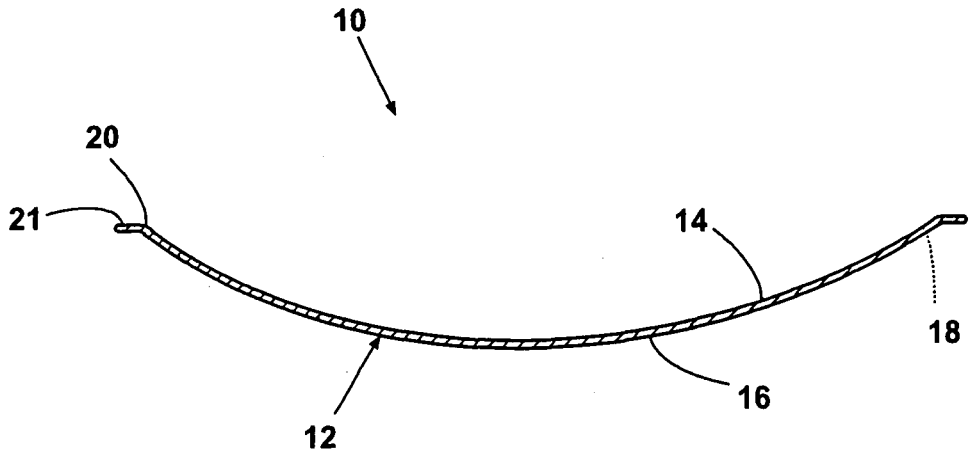
FIG. 2 a sectional view taken along line 2-2 of FIG. 1.
Figure 3:
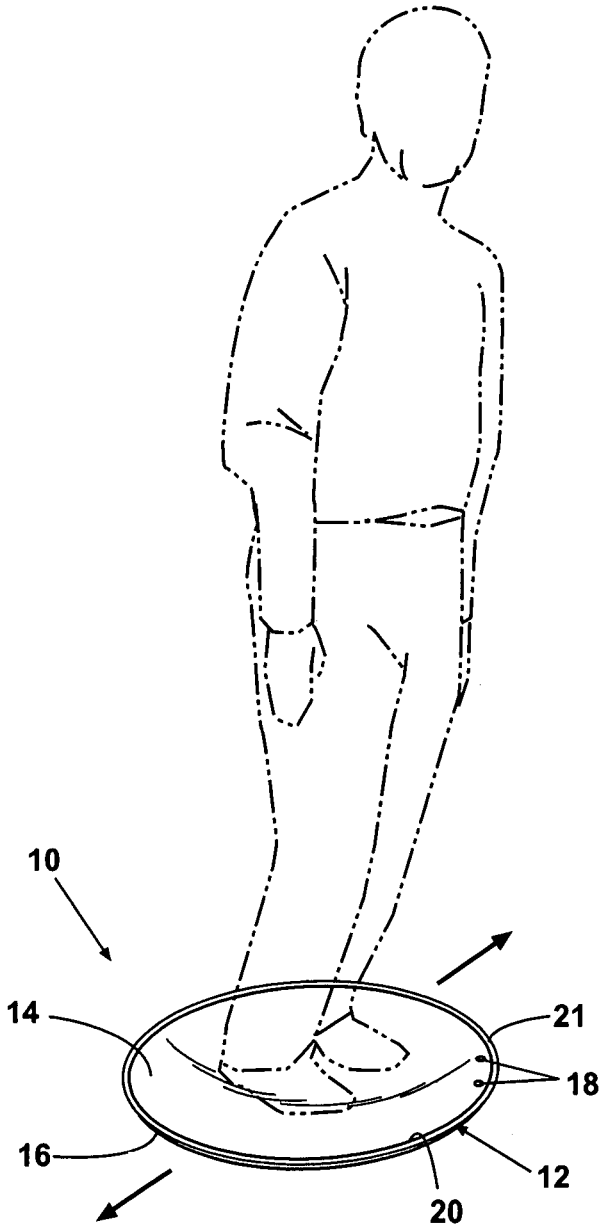
FIG. 3 is a perspective view of the device of FIG. 1 being used to perform a wobbling balance exercise.

Referring to the Figures and particularly to FIGS. 1-3, a balance training and exercise device 10 comprises a rigid, shallow, and concave disc 12 having an upper concave surface 14 and a lower convex surface 16. The disc 12 is reasonably thin and has a size adapted to accommodate the feet or knees of a large adult. The disc 12 can be made out of plastic, aluminum, or steel with varying degrees of rigidity. The disc 12 can be integrally formed in a manner which will preclude any perceivable deformation of the disc 12 when stood or kneeled upon by an individual of any size. If the disc 12 is deformable, the disc 12 is used with a pad 30 in order to prevent deformation, as is described hereinafter. Unlike a conventional children's snow disc, the disc 12 is substantially rigid to an extent that it maintains its shape when used and does not become dented or deformed as a result of applying weight. The disc 12 is formed of a relatively strong material suitable for this purpose. An exemplary means of forming the disc 12 would be by aluminum spinning. The disc 12 can be constructed having a constant radius of curvature. Alternatively, the disc 12 can compound different radii of curvature. For example, a small bottom portion of the disc 12 can be made generally flat while the upper portion has a noticeably smaller radius of curvature. Both the upper surface 14 and lower surface 16 of the disc 12 can be modified to include ridges, bumps, channels, and any similar modifications. A plurality of apertures 18 can be formed near a rim 20 of the disc 12. The apertures 18 can be of any size any shape suitable for the purposes described herein. A lip 21 comprising a circular flange can extend from the rim 20. The lip 21 is preferably formed integrally with the rim 20.

Figure 4:
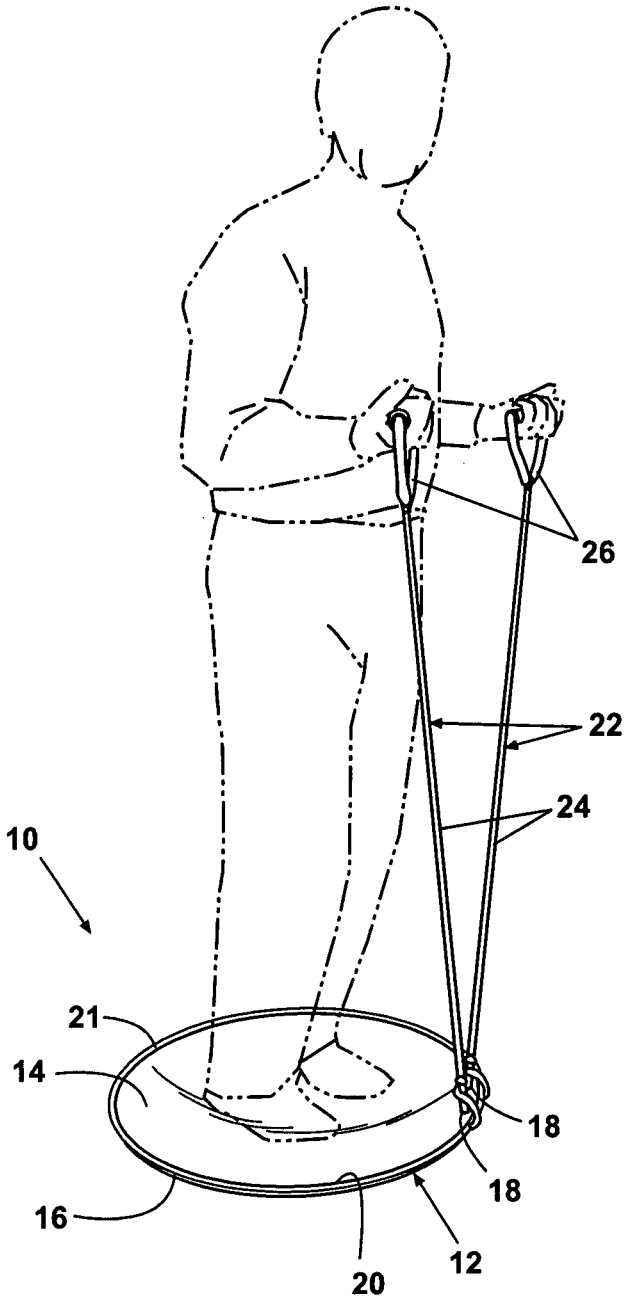
FIG. 4 is a perspective view of the device of FIG. 1 with optional removable arm strengthening means attached and being used to perform an arm strengthening exercise.
Figure 5:
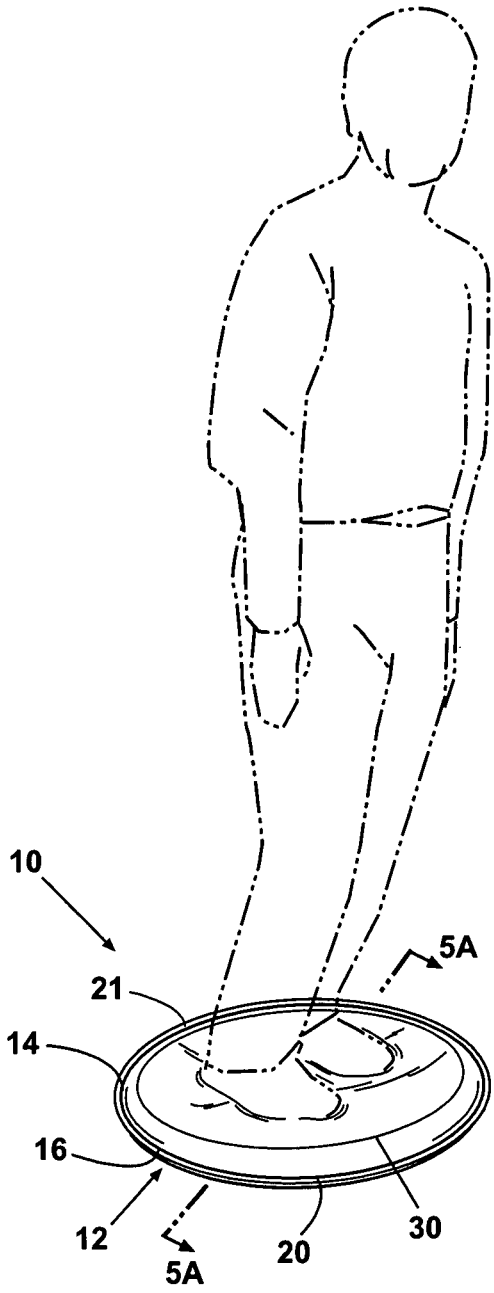
FIG. 5 is a perspective view of the device of FIG. 1 with optional pad and being stood upon by a user.
Figure 5A:
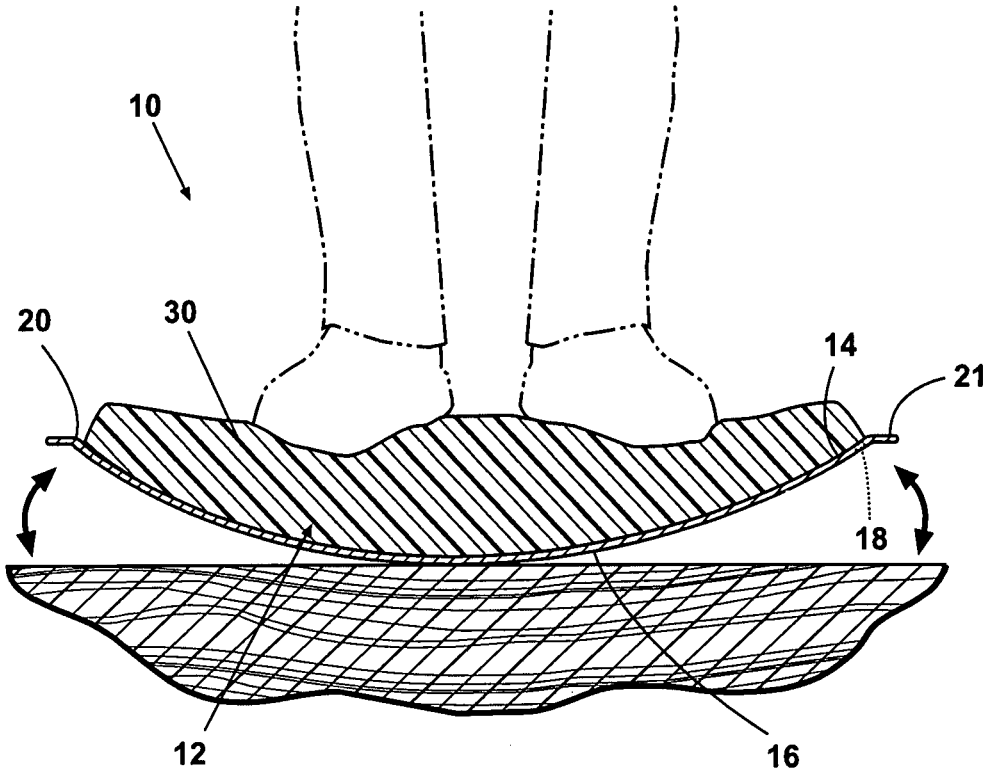
FIG. 5A is sectional view taken along line 5A-5A of FIG. 5.
Figure 6:
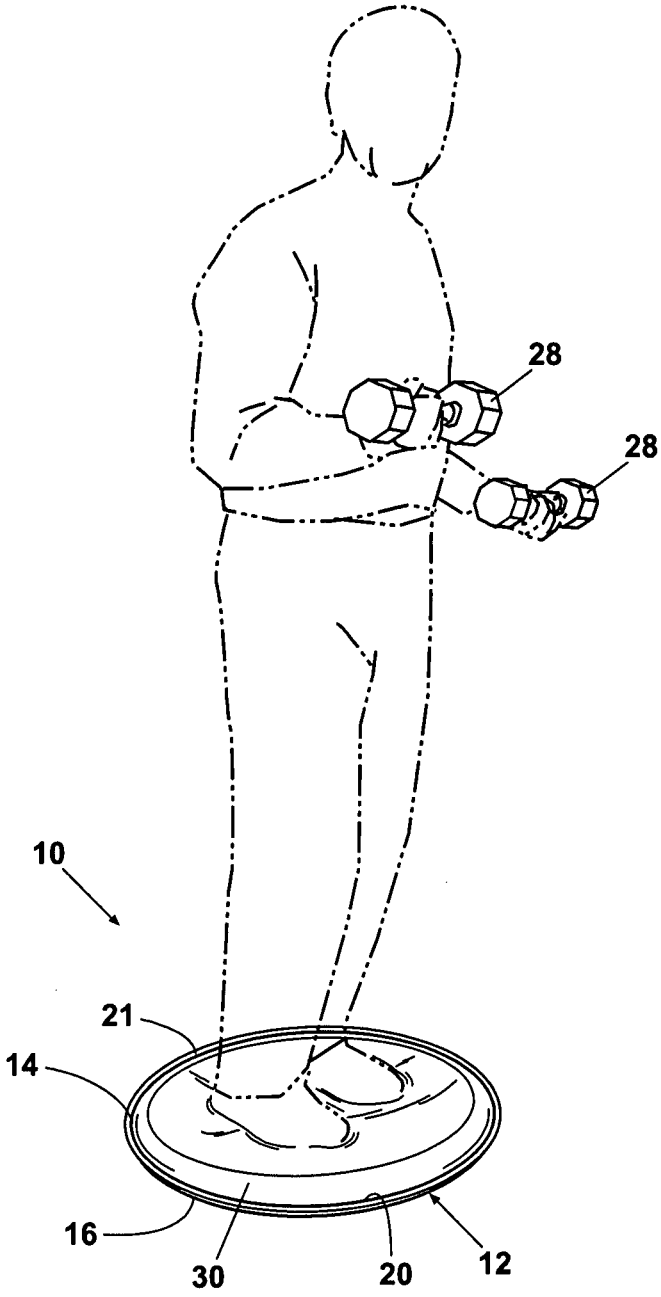
FIG. 6 is a perspective view of the device of FIG. 1 with optional separate arm strengthening means and optional pad, and being used to perform an arm strengthening exercise.

As best illustrated in FIG. 4, the device 10 further comprises optional removable arm strengthening means 22. The arm strengthening means 22 can be two elastic ropes 24 each having a handle 26 attached to one end. The ropes 24 are of a length adapted to extend from the disc 12 to a user's hands when the user is standing within the disc 12. The handles 26 are adapted to be comfortably held by a user and are secured to the ends of the ropes 24 in any suitable manner. Alternatively, optional separate arm strengthening means 28 can be used, as is shown in FIG. 6. The separate arm strengthening means 28 can be any objects capable of exercising a user's arms, such as weights designed to be held in the user's hand. The separate arm strengthening means 28 do not attach to the disc 12.

Referring now to FIGS. 5-8, a pad 30 is a thickened member having at least one surface adapted for the user to stand or kneel upon. The pad 30 is preferably formed integrally of relatively soft and resilient foam, as by molding, such that it conforms to the shape of the upper surface 14 when it is placed within the disc 12 so as substantially fill the concavity of the disc 12 and also is somewhat depressed to conform to a user's feet or shoes when a user is standing on the pad. However, the foam must be firm enough so that the user's feet are relatively fixed within the foam and the foam will not further deform or distort when the disc is in use. Alternatively, the pad 30 can be formed by molding the foam directly onto the upper surface 14 and into the disc 12. The pad 30 can have any shape and texture suitable for the purposes described herein. Preferably, the foam is characterized by a density of 2 to 25 lbs./ft$^3$, preferably in the range of about 5-18 lbs./ft$^3$.

Figure 9:
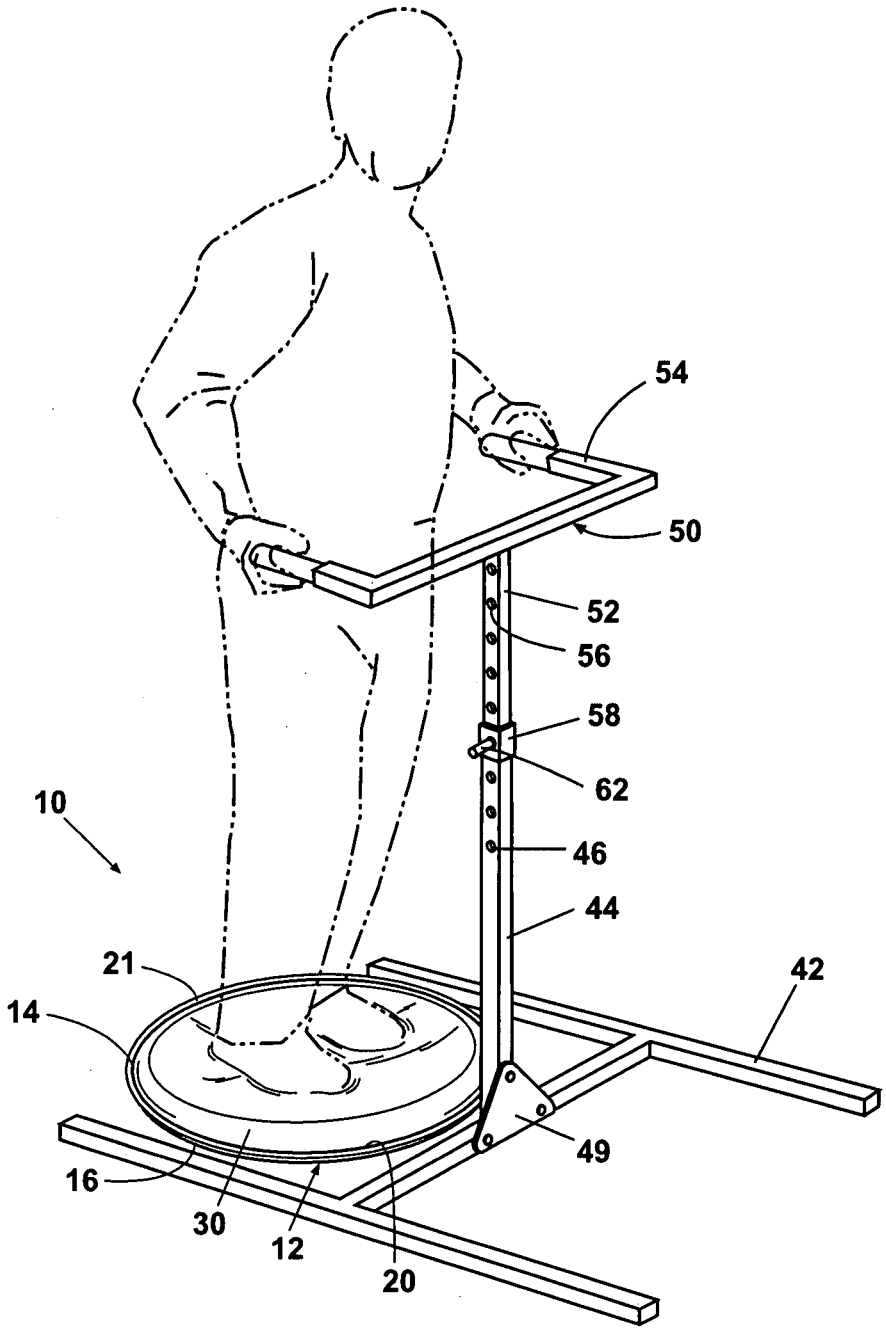
FIG. 9 is a perspective view of an optional user support that can be used with the balance training and exercise device shown in FIG. 1.

FIG. 9 illustrates an optional user support 40. The user support 40 comprises a base 42, an upright support member 44, and a hand grip 46. The base 42 is adapted to be placed on a support surface, such as a floor. The base 42 is also configured for placement of the disc 12 adjacent the base. The base 42 can be H-shaped as illustrated herein. Alternatively, the base 42 can me formed having any shape that provides suitable support and stability for the purposes described herein.

The upright support member 44 is preferably hollow and can have a square or rectangular cross-section. The upright support member 44 can be formed of any material having suitable strength and rigidity for the purposes described herein. An exemplary material would be steel. A plurality of apertures 46 are spaced along the left and right sides of the upright support member 44 such that each aperture 46 on the left is aligned with an aperture 46 on the right. The upright support member 44 extends vertically from the base 42 to an adjustable mounting 48. The upright support member 44 can be connected to the base by any suitable means, such as a by a supporting connector 49.

The hand grip 50 comprises a telescoping bar 52 and a handle portion 54. The telescoping bar 52 extends from the adjustable mounting 48 to the handle portion 54. The telescoping bar 52 has a diameter smaller than that of the upright support member 44 and is maintained in a telescoping relationship with the telescoping bar 52 by the adjustable mounting 48. A plurality of apertures 56 are spaced along the left and right sides of the upright support member 44 such that each aperture 56 on the left is aligned with an aperture 56 on the right. The handle portion 54 is attached to an uppermost portion of the telescoping bar 52 and can be formed similarly to the telescoping bar 52 but without apertures 56. Alternatively, the handle portion can have a different shape or texture than the telescoping bar 52. The handle portion and telescoping bar 52 are preferably formed integrally.

The adjustable mounting 48 can be formed of any material having suitable rigidity and strength for the purposes described herein. The adjustable mounting 48 comprises a sleeve 58 fixedly attached to an uppermost portion of the upright support member 44 and adapted to slidably receive the telescoping bar 52. The adjustable mounting 48 includes an inwardly-biased pin 62. The pin 62 is attached to the sleeve 58 and is biased inwardly by a spring or any other suitable means. The pin 62 is adapted to fit through any pairs of corresponding left and right apertures 46, 56 on the upright support member 44 and the telescoping bar 52, respectively.

Figure 10:
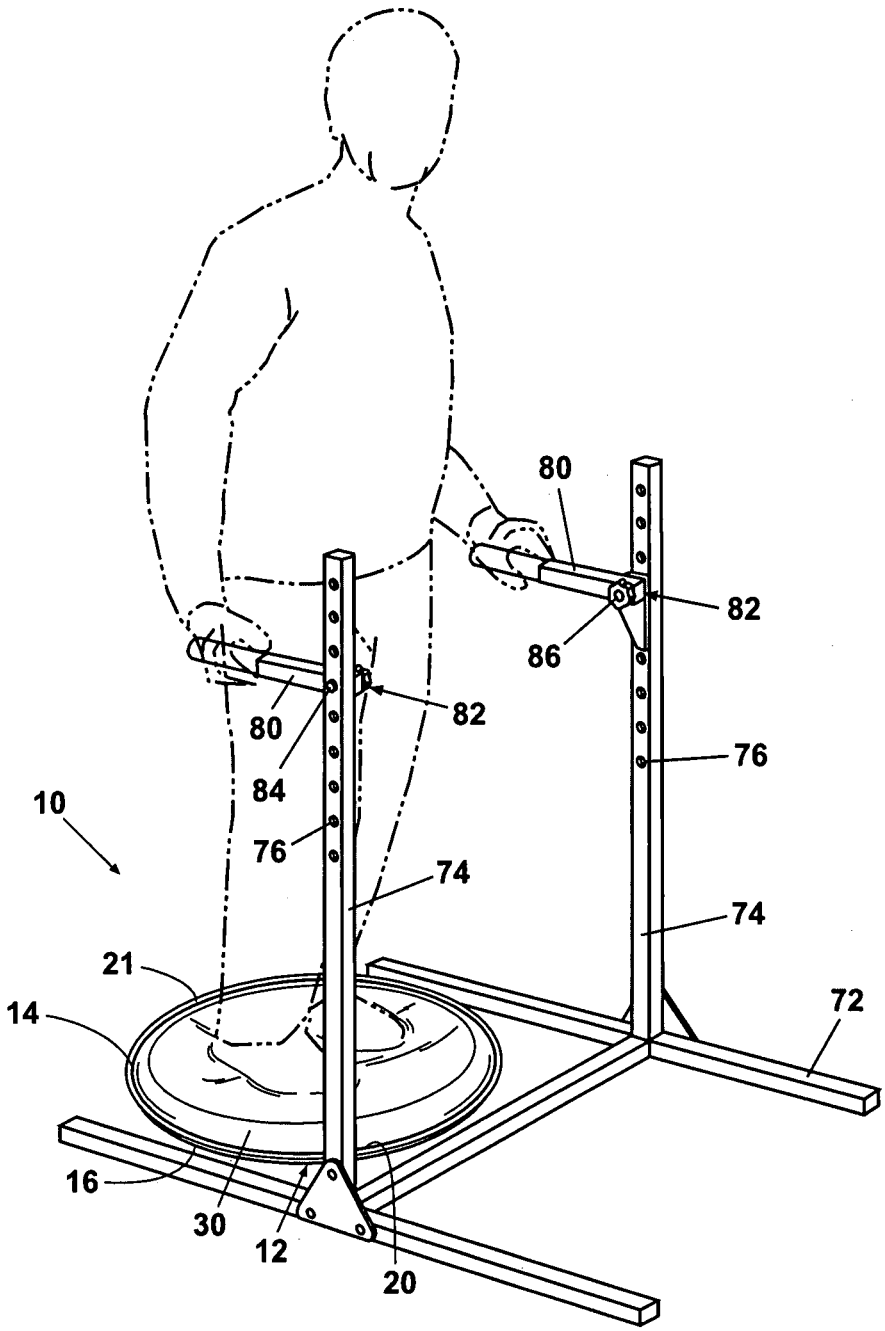
FIG. 10 is a perspective view of a second embodiment of optional user support that can be used with the balance training and exercise device shown in FIG. 1.

A second embodiment of the user support 70 shown in FIG. 10 comprises a base 72 identical to the base 42 of the first embodiment, two upright support members 74, and two hand grips 78. The upright support members 74 are preferably hollow and can have a square or rectangular cross-section. The upright support members 74 can be formed of any material having suitable strength and rigidity for the purposes described herein. An exemplary material would be steel. A plurality of apertures 76 are spaced along the left and right sides of each upright support member 74 such that each aperture 76 on the left is aligned with an aperture 76 on the right. The upright support members 74 extend vertically from the base 72 on opposite sides to height corresponding to the location of a tall adult user's hands. The upright support members 74 can be connected to the base 72 by any suitable means, such as a by a supporting connector 79.

The hand grips 78 each comprise and handle portion 80 and an adjustable mounting 82. The handle portions 80 can be formed similarly to the upright support members 74 but without apertures 76. Alternatively, the handle portions 80 can have a different shape or texture than the upright support member 74. The handle portion 80 and the adjustable mounting 82 preferably formed integrally. Each adjustable mounting 82 can be formed of any material having suitable rigidity and strength for the purposes described herein. Each adjustable mounting 82 is configured for attachment to a corresponding upright support member 74 by a pin 84. The pin 84 is adapted to fit through any pairs of corresponding left and right apertures 76 on each upright support member 74 as well as through left and right apertures 86 on each adjustable mounting such that the pin 84 secures each handle portion to its corresponding upright support member 74.

The height of the user support member 44 of the user support 40 can be adjusted by pulling the pin 62 outward from the apertures 46, 56 while sliding the telescoping bar 52 up or down. Once a suitable position has been located, the pin 62 can be released into apertures 46, 56 at the new position.

The height of each hand grip 78 of the user support 70 can be adjusted by removing the pin 84 from the apertures 76, 86. The hand grip 78 can then be moved to a desired height, and the pin 84 can be inserted into apertures 76, 86 at the new position.

When used, the removable arm strengthening means 22 can be removably attached to the disc 12 in any suitable manner, such as by stringing the ends of the ropes 24 not attached to the handles 26 through apertures 18 and then tying each rope 24 to itself with a secure knot. The removable arm strengthening means 22 can be removed by untying the knot and pulling the ropes 24 out of the apertures 18. When used, the pad 30 is placed within the disc 12 in a manner in which the pad 30 substantially conforms to the upper surface 14 of the disc 12. The side of the pad 30 adapted to accommodate the feet of a user faces upwardly.

When used, the disc 12 can be moved adjacent the user support 40, 70 as illustrated in FIGS. 9 and 10. The user can hold onto the hand grips 50, 78 while performing a balance exercise. The user can pull upward on the hand grips 50, 78 to increase the resistance and gravity load during exercise as shown in FIG. 9, which serves to increase the difficulty of the exercise. Alternatively, the user can press downward on the hand grips 50, 78 in order to decrease the resistance and gravity load during exercise as shown in FIG. 10, which serves to decrease the difficulty of the exercise.

A user stands or kneels inside the disc 12 in order to exercise. The feet or knees are placed in any position on the upper surface 14 or pad 30 if the pad 30 is being used to enable the user to perform balance exercises on the disc 12. The user can perform exercises on a variety of surfaces, such as carpet, grass, cement, or hardwood floors.

Figure 7:
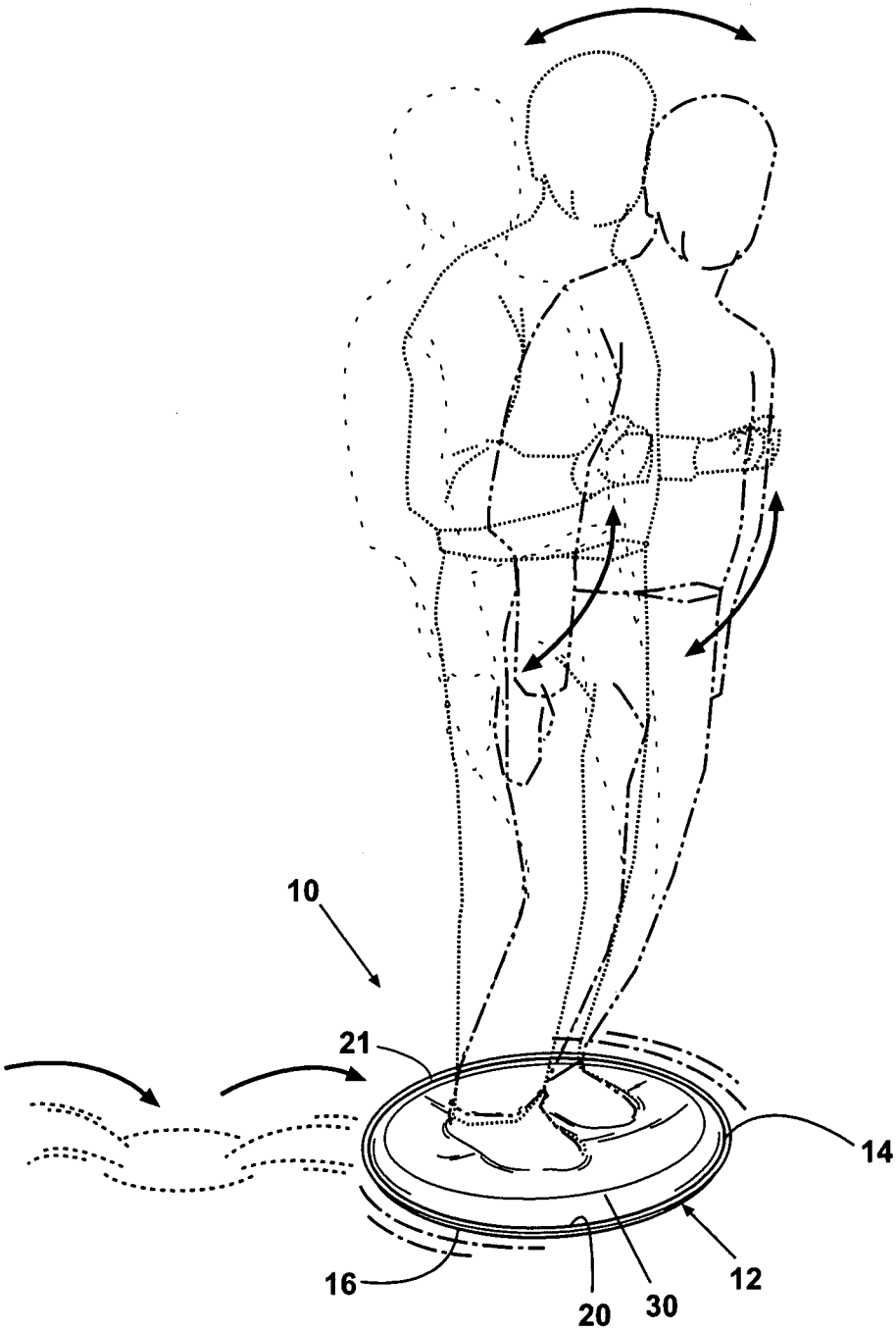
FIG. 7 is a perspective view of the device of FIG. 1 with optional pad and being used to perform a combination twisting and wobbling balance exercise.
Figure 8:
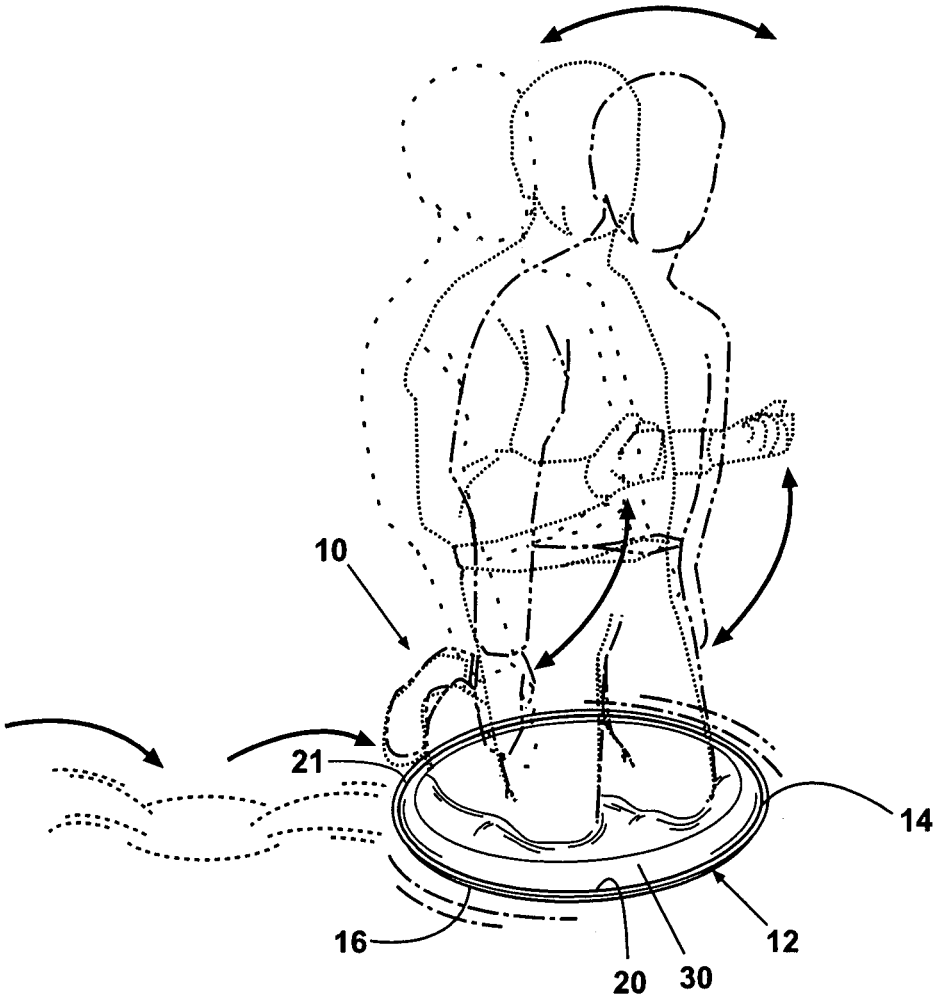
FIG. 8 is a perspective view of the device of FIG. 1 with optional pad and being used to perform a combination twisting and wobbling balance exercise.

To perform an arm exercise using the removable arm strengthening means 22, a user grabs tightly onto one handle 26 with each hand and pulls the handles 26 in a direction away from the disc 12. This causes the ropes 24 to stretch. The resistance of the ropes 24 to stretching exercises the arms. To perform an arm exercise using the separate arm strengthening means 28, a user holds one of the separate arm strengthening means 28, such as a weight, in each hand. The user then moves his or her hand in a manner resulting in exercising of the muscles in the arm. The user can also move his or her arm up and down without holding any equipment, as shown in FIGS. 7 and 8. This will still exercise the arm in an excellent manner, albeit it less intense exercise.

To perform a balance exercise, a user moves in a manner causing rotation, translation, or a combination thereof of the device 10 while optionally using the user support 40, 70. Movement of the feet or knees results in a twisting or rocking motion due to the fact that the user is standing inside a concave object. Moreover, the concave shape of the inside surface on which the user stands or kneels along with the rigidity of the disc 12 enables a drastically greater degree of movement than would be allowed by a device having a flat or deformable standing or kneeling surface. Standing or kneeling on the concave upper surface 14 enables the user to maintain his or her position inside the disc 12 despite being subjected to such an increased degree of motion. The degree of difficulty of exercise and the dynamics of motion can also be altered by changing the radius of curvature of the disc 12. In addition, the user can alter his or her foot stance to change the dynamics of motion: the user can widen his or her foot stance to increase motion, or the user can narrow his or her foot stance to decrease motion. By creating an optional flatter portion towards the bottom of the disc 12, even beginners can exercise easily due to an increased level of stability. The addition of the user support 40, 70 also provides additional dynamics control of the exercise. Less experienced users can also practice completing less difficult balancing-only exercises while using the user support 40, 70 and then transition to translational wobbling exercises. This enables the user to practice in a more controlled manner, which can be particularly beneficial for rehabilitation of users suffering from an injury or loss of movement.

Most importantly, using the pad 30 inside the disc 12 when performing exercises makes exercising more comfortable to the user and, at the same time, increases the exercise dynamics. This is due to the fact that the resiliency of the pad 30 creates additional movement as compared to the movement experienced when using only the disc 12. As the disc 12 moves in a given direction, the pad 30 can move in a separate direction due to the weight of the feet or knees pressing into it. Because the user's weight causes the portion of the pad 30 on which he or she is standing to move downward below the rim 20 of the disc 12, the benefits of standing or kneeling on a concave surface are again achieved. Thus, the user is able to maintain a position inside the disc 12 while experiencing highly dynamic motion and increasing the involvement of the central nervous system. Use of the pad 30 provides a better and more challenging workout due to the added instability.

To perform a twist balancing exercise, a user twists from side to side using the torso and upper body, resulting in rotation of the device 10. This primarily exercises the arms, legs, and the abdominal region. A user can also perform a wobbling balance exercise in which the user shifts his or her weight from one foot or knee to the other repeatedly. This will cause the device 10 to rock from side to side. The device can also be made to translate across a distance if a user shifts his or her weight from side to side while twisting at the same time. When the weight is shifted to one foot or knee, that foot or knee moves downward, pressing into a side of the upper surface 14 or pad 30 and forcing that side of the disc 12 downward. The other foot or knee rises upward with the other side of the disc 12. At the same time, a user can twist outwardly with the downward foot to move forward, or the user can twist inwardly with the downward foot to move backward. This combination will result in the device pivoting from side to side to a new position away from the initial position of use.

All of the aforementioned exercises increase ankle, foot, and general leg strength while improving a user's balancing skills and providing an excellent cardiovascular workout. The torso is also thoroughly exercised by the twisting motion. In addition, by bending at the knees or at the waist when exercising in the standing or kneeling positions respectively, the degree of difficulty of the exercise is increased. The gluteus muscles can be intensely exercised in this manner.

The simple shape of the device 10 combined with its strength and optional modifications enable an efficient and easy means of increasing balancing ability and strengthening and toning the ankles, feet, legs, gluteus muscles, torso, and arms. While increasing the level of difficulty of balancing, the level of nerve excitement during exercise is increased, which in turn increases the overall response of the nervous system. A higher degree of response on behalf of the central nervous system is associated with a more thorough workout of the entire body. This results in a more intense workout and quicker, safer, and better results. In addition, the use of the removable arm strengthening means 22 or separate arm strengthening means 28 provides an excellent upper body workout. The addition of arm movement also intensifies the cardiovascular workout provided by the device 10. The optional pad 30 provides an increased imbalance to the user to enhance the exercise. The stiffer the pad, the more the imbalance While the invention has been specifically described in connection with certain specific embodiments thereof, it is to be understood that this is by way of illustration and not of limitation. For example, the disc has been described as being partially spherical in its inside and outside curvature, but it is in within the scope of the invention to make the upper and/or lower surfaces to be a complex curvature rather than a regular curvature. In addition, the upper surface can be relatively flat whereas the lower surface can have a simple or complex curvature. Reasonable variation and modification are possible within the scope of the forgoing disclosure and drawings without departing from the spirit of the invention which is defined in the appended claims.

What is claimed is:

1. A balance training and exercise device for use on a relatively flat support surface and consisting essentially of:

a shallow, concave one piece disc terminating in a rim and having a concave upper surface adapted to support the feet or knees of a human user and a corresponding convex lower surface that is adapted to rest on the support surface and that defines in a central portion a convex partial substantially spherical shape of substantially uniform curvature on which the disc is supported on the support surface;

a pad adapted to be placed on or mounted on the upper surface of the disc and is shaped to conform with the upper surface of the disc so as to substantially fill the volume of the concavity of the disc, wherein the pad has a substantially horizontal upper surface that is adapted to support the feet or knees of a user at or near the rim of the disc when the pad is placed within the disc, wherein the pad is made of a resilient foam that is compressible under the weight of a user but that otherwise maintains its integrity under the weight of a user, wherein the substantially horizontal upper surface is at or near the rim of the disc when the pad is mounted on the upper surface of the disc;

wherein the disc and pad are formed to impart sufficient rigidity to the disc so that the disc maintains its rigidity so that the disc functionally maintains its curvature on the bottom surface thereof beneath the feet of the user so that the user can perform a balance exercise by wobbling from side to side, front to back and rotational movement on the convex lower surface of the disc in place or for translational movement of the disc across the support surface by wobbling to one side of the disc, twisting the disc forwardly or rearwardly and wobbling the disc to another side to move the disc forwardly or rearwardly.

2. The balance training and exercise device of claim 1 wherein the disc is formed of aluminum, steel, or plastic.

3. The balance training and exercise device of claim 1 wherein the upper surface of the pad extends above the rim of the disc.

4. The balance training and exercise device of claim 1 and further comprising at least one elastic rope attached at one end to the disc and having a length adapted to extend from the disc to a hand of the user when the user is standing on the disc.

5. The balance training and exercise device of claim 4 wherein the elastic rope has a handle on another end adapted to be held by a user.

6. The balance training and exercise device of claim 4 wherein the one end of the rope extends through an aperture near a rim of the disc.

7. The balance training and exercise device of claim 1 and further comprising:

a user support comprising a base that is adapted to be placed along the support surface adjacent the disc;

at least one upright support member rigidly secured at a lower end to the base; and a hand grip mounted to an upper portion of the upright support member and adapted to be grasped by a user standing on the disc;

wherein the user can partially stabilize his or her balance while performing exercises on the disc.

8. The balance training and exercise device of claim 7 wherein the upright support member comprises a pair of telescoping tubes that are selectively adjustable to adjust the height of the hand grip from the support surface.

9. The balance training and exercise device of claim 7 wherein the hand grips are adjustably mounted to the support surface for selective adjustment of the height of the hand grips with respect to the support surface.

10. A method for performing an exercise for improving balance comprising:

standing or kneeling on the substantially horizontal upper surface of the pad of the balance training and exercise device of claim 1 when positioned with the disc with the lower surface thereon resting on a support surface, and wobbling the exercise device from side to side or forwardly and backwardly or any combination thereof.

11. The method for performing an exercise according to claim 10 wherein exercise device is articulated by twisting the disc to move the disc along the support surface during the wobbling act.

12. The balance training and exercise device of claim 1 wherein the pad is made of polyurethane or polyvinyl acetate.

13. The balance training and exercise device of claim 12 wherein the pad is made of a self-skinning polyurethane foam.

14. The balance training and exercise device of claim 13 wherein the polyurethane foam has a density in the range of about 5-18 lbs./ft$^3$.

15. The balance training and exercise device of claim 14 wherein the polyurethane foam has a density of about 18 lbs./ft$^3$.

16. The balance training and exercise device of claim 1 wherein the pad is removably mountable on the disc.

* * * * *